US011879204B2

(12) United States Patent
Duncan

(10) Patent No.: US 11,879,204 B2
(45) Date of Patent: Jan. 23, 2024

(54) LAUNDRY BASKET LINING DEVICE

(71) Applicant: Shirley Duncan, Kent, WA (US)

(72) Inventor: Shirley Duncan, Kent, WA (US)

( * ) Notice: Subject to any disclaimer, the term of this patent is extended or adjusted under 35 U.S.C. 154(b) by 246 days.

(21) Appl. No.: 17/529,354

(22) Filed: Nov. 18, 2021

(65) Prior Publication Data

US 2023/0151538 A1 May 18, 2023

(51) Int. Cl.
*D06F 95/00* (2006.01)

(52) U.S. Cl.
CPC ..... *D06F 95/004* (2013.01)

(58) Field of Classification Search
CPC ..... D06F 95/002; D06F 95/004
USPC ..... 232/1 B
See application file for complete search history.

(56) References Cited

U.S. PATENT DOCUMENTS 2,761,480 A * 9/1956 Tames ..... D06F 95/004 383/6
2,823,923 A * 2/1958 Marquardt ..... B62B 1/12 280/654
3,161,391 A * 12/1964 Bahnsen ..... D06F 95/004 248/99
3,349,936 A * 10/1967 Morton ..... A47G 29/06 383/7
3,369,584 A * 2/1968 Faccio ..... D06F 95/004 383/7
3,659,816 A * 5/1972 Wilson ..... D06F 95/004 248/97
3,943,988 A * 3/1976 Consorti ..... B65D 33/16 383/7
4,180,113 A * 12/1979 Liebling ..... D06F 95/004 383/7
4,218,103 A * 8/1980 Bacskay ..... D06F 95/004 312/211
4,354,543 A * 10/1982 Bogner ..... B65B 67/12 220/283
4,822,178 A * 4/1989 Taylor ..... D06F 95/004 383/33
D341,685 S 11/1993 Brooks
5,356,024 A 10/1994 Ho
5,507,577 A * 4/1996 Fowler ..... D06F 95/002 383/7
D550,912 S 9/2007 Kempse
8,910,857 B1 12/2014 Hegarty
11,603,625 B2 * 3/2023 Noel ..... D06F 95/008
2003/0116565 A1 * 6/2003 Liu ..... D06F 95/002 220/9.4
2012/0308165 A1 * 12/2012 Poldervaart ..... D06F 95/002 383/102
2019/0092510 A1 * 3/2019 Ribbe ..... B65B 67/1238
2019/0169790 A1 * 6/2019 Bellamy ..... D06F 95/006

(Continued)

FOREIGN PATENT DOCUMENTS

JP 2015165882 A * 9/2015
WO WO9803401 1/1998

*Primary Examiner* — William L Miller

(57) ABSTRACT

A laundry basket lining device for preventing contact of a user's laundry with a laundry basket includes a sleeve, which is insertable into a laundry basket so that the sleeve covers an interior surface and a rim of the laundry basket. The sleeve is selectively engageable to the laundry basket so that sleeve is removably engaged to the laundry basket. The sleeve thus prevents contact of a user's laundry with the laundry basket.

14 Claims, 4 Drawing Sheets

(56) References Cited

U.S. PATENT DOCUMENTS

| | | | | |
|---|---|---|---|---|
| 2021/0348322 | A1* | 11/2021 | Noel | D06F 95/008 |
| 2023/0160137 | A1* | 5/2023 | Forgacs | D06F 95/004 232/1 B |

* cited by examiner

LAUNDRY BASKET LINING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lining devices and more particularly pertains to a new lining device for preventing contact of a user's laundry with a laundry basket. The present invention discloses a lining device comprising a flexible sleeve selectively insertable into and engageable to a laundry basket, particularly a laundry basket available for public use. The flexible sleeve prevents contact of a user's laundry with the laundry basket.

(2) Description of Related Art Including Information Disclosed Under 37 CFR 1.97 and 1.98

The prior art relates to lining devices. Prior art lining devices may comprise flexible clothes hampers, bags for use with laundry baskets, and baskets that are attachable to washers and dryers. What is lacking in the prior art is a lining device comprising a flexible sleeve selectively insertable into and engageable to a laundry basket, particularly a laundry basket available for public use. The flexible sleeve prevents contact of a user's laundry with the laundry basket.

BRIEF SUMMARY OF THE INVENTION

An embodiment of the disclosure meets the needs presented above by generally comprising a sleeve, which is configured for insertion into a laundry basket so that the sleeve covers an interior surface and a rim of the laundry basket. The sleeve is configured to selectively engage the laundry basket so that sleeve is removably engaged to the laundry basket. The sleeve thus is configured to prevent contact of a user's laundry with the laundry basket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
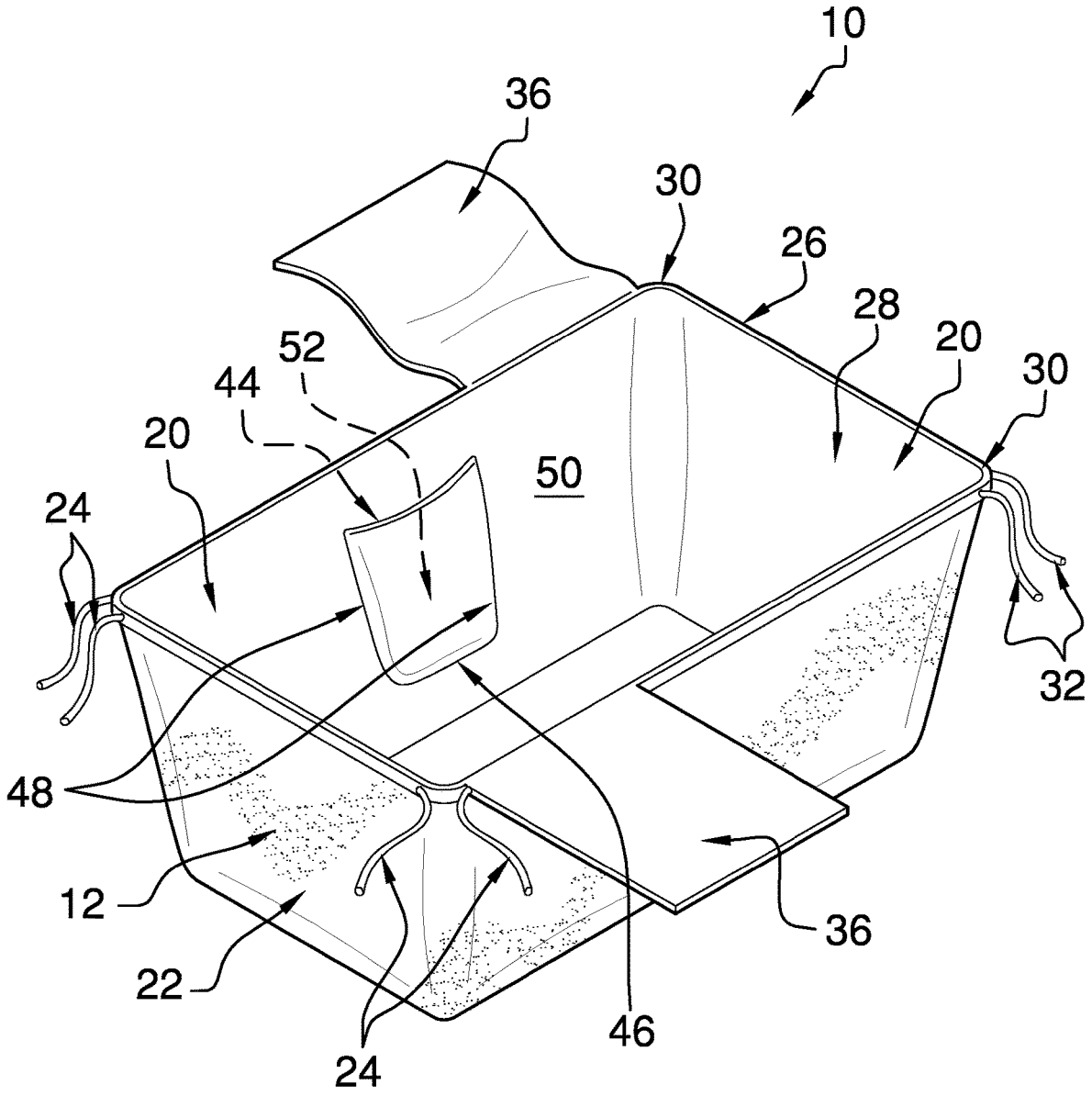
FIG. 1 is an isometric perspective view of a laundry basket lining device according to an embodiment of the disclosure.

With reference now to the drawings, and in particular to FIGS. 1 through 4 thereof, a new lining device embodying the principles and concepts of an embodiment of the disclosure and generally designated by the reference numeral 10 will be described.

As best illustrated in FIGS. 1 through 4, the laundry basket lining device 10 generally comprises a sleeve 12, which is configured for insertion into a laundry basket 14 so that the sleeve 12 covers an interior surface 16 and a rim 18 of the laundry basket 14. The sleeve 12 is configured to selectively engage the laundry basket 14 so that the sleeve 12 is removably engaged to the laundry basket 14. The sleeve 12 thus is configured to prevent contact of a user's laundry with the laundry basket 14.

The sleeve 12 comprises an inner layer 20 and an outer layer 22. The outer layer 22 comprises cloth, fabric, elastomer, or the like. The inner layer 20 comprises plastic so that the sleeve 12 is resiliently flexible and so that the inner layer 20 is substantially impermeable to water. The inner layer 20 would be in contact with the user's laundry.

The sleeve 12 is substantially cuboid shaped when engaged to the laundry basket 14. A plurality of couplers 24 is engaged to the sleeve 12 and is positioned on a perimeter 26 of a top 28 of the sleeve 12. The couplers 24 are configured to selectively engage the laundry basket 14 so that sleeve 12 is removably engaged to the laundry basket 14.

The couplers 24 may be positioned singly proximate to upper corners 30 of the sleeve 12, although the present invention also anticipates the couplers being positioned between the upper corners 30. Each coupler 24 may comprise a pair of strings 32, or other coupling means, such as, but not limited to, hook and loop straps, magnets, and the like. The strings 32 are configured for insertion through adjacently positioned apertures 34 in the laundry basket 14.

The user then is positioned to reversibly knot the strings 32 to engage the sleeve 12 to the laundry basket 14.

Figure 4:
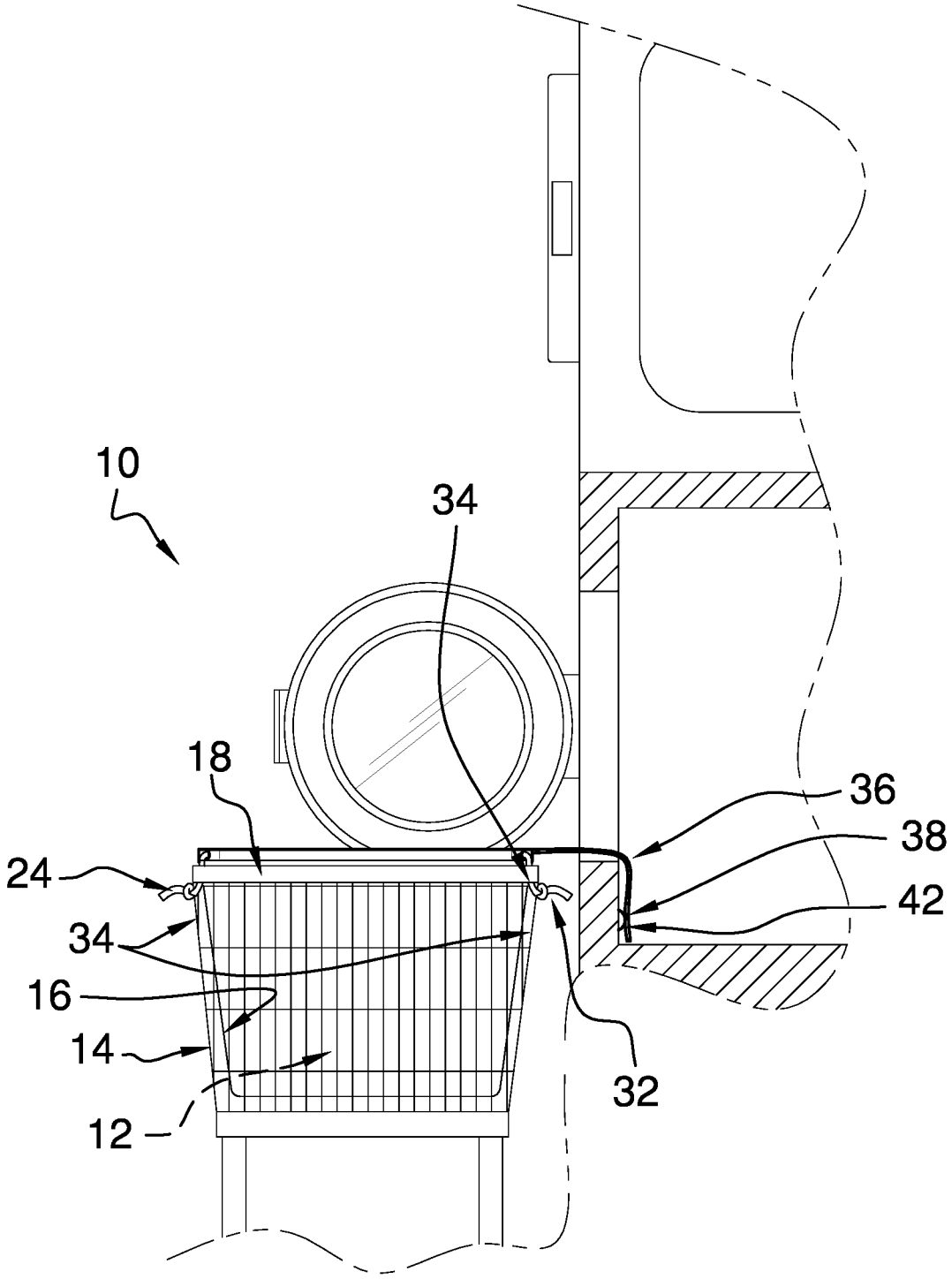
FIG. 4 is an in-use view of an embodiment of the disclosure.

The laundry basket lining device 10 also may comprise a flap 36, which is engaged to and which extends from the perimeter 26 of the top 28 of the sleeve 12. A fastener 38 is engaged to the flap 36 distal from the sleeve 12. The fastener 38 is configured to engage a surface of a washing machine or a dryer, as shown in FIG. 4, so that the flap 36 covers a lower portion of a circumference of an opening in the washing machine or the dryer. The flap 36 is configured to prevent contact of the user's laundry with the circumference of the opening while transferring the laundry between the sleeve 12 and the washing machine or the dryer.

The fastener 38 may comprise a pair of cups 42, or other fastening means, such as, but not limited to, magnets, pressure sensitive adhesives, and the like. The cups 42 comprise rubber, silicone, or elastomer and thus are resiliently compressible. The cups 42 are configured to be selectively compressed against the surface of the washing machine or the dryer to removably engage the flap 36 to the surface.

Figure 2:
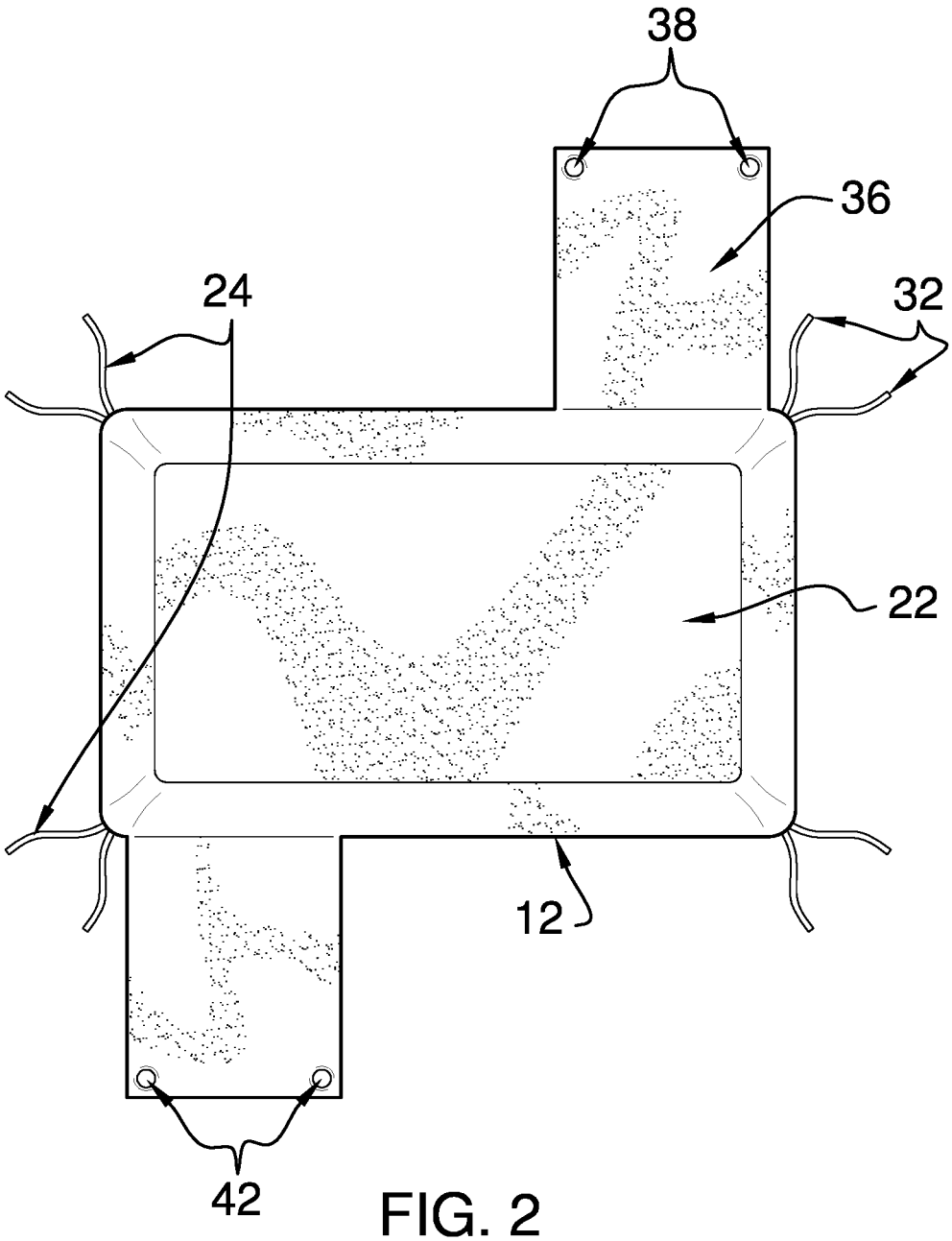
FIG. 2 is a bottom view of an embodiment of the disclosure.
Figure 3:
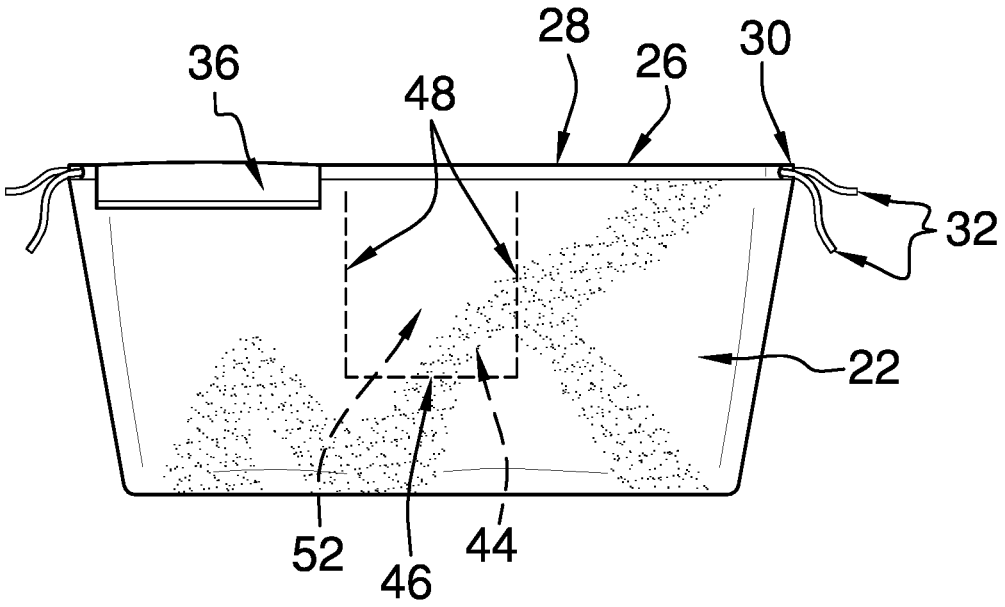
FIG. 3 is a side view of an embodiment of the disclosure.

As shown in FIG. 2, the flap 36 may be one of a pair of flaps 36. Each flap 36 is engaged to the sleeve 12 proximate to a respective upper corner 30 so that the flaps 36 of the pair of flaps 36 are positioned diagonally across the perimeter 26 of the top 28 of the sleeve 12. Having two flaps 36 engaged to the sleeve 12 prevents the user from potentially having to rotate the laundry basket 14 to align the flap 36 with the opening in the washing machine or the dryer.

The laundry basket lining device 10 also may comprise a panel 44, which has a bottom edge 46 and opposed side edges 48 that are engaged to an inner face 50 of the sleeve 12 to define a pocket 52. The pocket 52 is configured for positioning of an item, such as a laundry aid, cellphone, keys, or the like.

In use, the sleeve 12 is positioned in the laundry basket 14 to cover the interior surface 16 and the rim 18 of the laundry basket 14. The strings 32 of each pair of strings 32 are inserted through respective apertures 34 in the laundry basket 14 and knotted. If desired, the flap 36 can by inserted through the opening in a washing machine and attached to the surface using the cups 42. The user's laundry then can be unloaded from the washing machine into the sleeve 12 without the laundry contacting the laundry basket 14. The user then can move the laundry basket 14 to a dryer and reverse the process to transfer the laundry from the sleeve 12 into the dryer. After drying the laundry, it can again be transferred to the sleeve 12 in the same way as it was transferred from the washing machine to the sleeve 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A laundry basket lining device comprising:

a sleeve configured for insertion into a laundry basket, such that the sleeve covers an interior surface and a rim of the laundry basket, the sleeve being configured for selectively engaging the laundry basket, such that sleeve is removably engaged to the laundry basket, wherein the sleeve is configured for preventing contact of a user's laundry with the laundry basket, the sleeve being substantially cuboid shaped when engaged to the laundry basket;

a flap engaged to and extending from a perimeter of a top of the sleeve; and a fastener engaged to the flap distal from the sleeve, the fastener being configured for engaging a surface of a washing machine or a dryer, such that the flap covers a lower portion of a circumference of an opening in the washing machine or the dryer, wherein the flap is configured for preventing contact of the user's laundry with the circumference of the opening while transferring the laundry between the sleeve and the washing machine or the dryer.

2. The laundry basket lining device of claim 1, wherein the sleeve comprises an inner layer and an outer layer, the outer layer comprising cloth, the inner layer comprising plastic, such that the sleeve is resiliently flexible and such that the inner layer is substantially impermeable to water.

3. The laundry basket lining device of claim 1, further including a plurality of couplers engaged to the sleeve and positioned on a perimeter of a top of the sleeve, the couplers being configured for selectively engaging the laundry basket, such that sleeve is removably engaged to the laundry basket.

4. The laundry basket lining device of claim 3, wherein:

the sleeve is substantially cuboid shaped when engaged to the laundry basket; and the couplers are positioned singly proximate to upper corners of the sleeve.

5. The laundry basket lining device of claim 1, wherein the fastener comprises a pair of cups, the cups comprising rubber, silicone, or elastomer, such that the cups are resiliently compressible, wherein the cups are configured for being selectively compressed against the surface of the washing machine or the dryer for removably engaging the flap to the surface.

6. The laundry basket lining device of claim 1, wherein the flap is one of a pair of flaps, each flap being engaged to the sleeve proximate to a respective upper corner of said sleeve, such that the flaps of the pair of flaps are positioned diagonally across the perimeter of the top of the sleeve.

7. The laundry basket lining device of claim 1, further including a panel having a bottom edge and opposed side edges engaged to an inner face of the sleeve defining a pocket, wherein the pocket is configured for positioning of an item.

8. The laundry basket lining device of claim 1, further comprising:

the sleeve comprising an inner layer and an outer layer, the outer layer comprising cloth the inner layer comprising plastic, such that the sleeve is resiliently flexible and such that the inner layer is substantially impermeable to water;

a plurality of couplers engaged to the sleeve and positioned on a perimeter of a top of the sleeve, the couplers being configured for selectively engaging the laundry basket, such that sleeve is removably engaged to the laundry basket, the couplers being positioned singly proximate to upper corners of the sleeve, each coupler comprising a pair of strings, wherein the strings are configured for insertion through adjacently positioned apertures in the laundry basket, positioning the user for reversibly knotting the strings for engaging the sleeve to the laundry basket;

the fastener comprising a pair of cups, the cups comprising rubber, silicone or elastomer, such that the cups are resiliently compressible, wherein the cups are configured for being selectively compressed against the surface of the washing or the dryer for removably engaging the flap to the surface, the flap being one of a pair of flaps, each flap being engaged to the sleeve proximate to a respective upper corner, such that the flaps of the pair of flaps are positioned diagonally across the perimeter of the top of the sleeve; and a panel having a bottom edge and opposed side edges engaged to an inner face of the sleeve defining a pocket, wherein the pocket is configured for positioning of an item.

9. A laundry basket lining device comprising:

a sleeve configured for insertion into a laundry basket, such that the sleeve covers an interior surface and a rim of the laundry basket, the sleeve being configured for selectively engaging the laundry basket, such that sleeve is removably engaged to the laundry basket, wherein the sleeve is configured for preventing contact of a user's laundry with the laundry basket;

a plurality of couplers engaged to the sleeve and positioned on a perimeter of a top of the sleeve, the couplers being configured for selectively engaging the laundry basket, such that sleeve is removably engaged to the laundry basket;

wherein the sleeve is substantially cuboid shaped when engaged to the laundry basket;

wherein the couplers are positioned singly proximate to upper corners of the sleeve; and wherein each coupler comprises a pair of strings, wherein the strings are configured for insertion through adjacently positioned apertures in the laundry basket, positioning the user for reversibly knotting the strings for engaging the sleeve to the laundry basket.

10. A laundry basket lining system comprising:

a laundry basket;

a sleeve selectively insertable into the laundry basket, such that the sleeve covers an interior surface and a rim of the laundry basket, the sleeve being selectively engageable to the laundry basket, such that sleeve is removably engaged to the laundry basket, wherein the sleeve is configured for preventing contact of a user's laundry with the laundry basket, the sleeve being substantially cuboid shaped;

a flap engaged to and extending from a perimeter of a top of the sleeve; and a fastener engaged to the flap distal from the sleeve, the fastener being configured for engaging a surface of a washing machine or a dryer, such that the flap covers a lower portion of a circumference of an opening in the washing machine or the dryer, wherein the flap is configured for preventing contact of the user's laundry with the circumference of the opening while transferring the laundry between the sleeve and the washing machine or the dryer.

11. The laundry basket lining system of claim 10, wherein the sleeve comprises an inner layer and an outer layer, the outer layer comprising cloth, the inner layer comprising plastic, such that the sleeve is resiliently flexible and such that the inner layer is substantially impermeable to water.

12. The laundry basket lining system of claim 10, wherein the fastener comprises a pair of cups, the cups comprising rubber, silicone, or elastomer, such that the cups are resiliently compressible, wherein the cups are configured for being selectively compressed against the surface of the washing machine or the dryer for removably engaging the flap to the surface.

13. The laundry basket lining system of claim 10, wherein the flap is one of a pair of flaps, each flap being engaged to the sleeve proximate to a respective upper corner of said sleeve, such that the flaps of the pair of flaps are positioned diagonally across the perimeter of the top of the sleeve.

14. The laundry basket lining system of claim 10, further including a panel having a bottom edge and opposed side edges engaged to an inner face of the sleeve defining a pocket, wherein the pocket is configured for positioning of an item.

* * * * *